United States Patent [19]

Butzen

[11] 4,421,096

[45] Dec. 20, 1983

[54] VENT DAMPER DRIVE

[76] Inventor: Thomas J. Butzen, 3448 Colony Dr., Greenfield, Wis. 53221

[21] Appl. No.: 435,781

[22] Filed: Oct. 21, 1982

Related U.S. Application Data

[63] Continuation of Ser. No. 253,124, Apr. 10, 1981, abandoned, which is a continuation of Ser. No. 93,479, Nov. 13, 1979, Pat. No. 4,262,652.

[51] Int. Cl.[3] ..... F23L 3/00

[52] U.S. Cl. ..... 126/285 B; 236/1 G; 192/142 R

[58] Field of Search ..... 236/1 G; 431/20; 126/285 R, 285 B, 289; 192/142 R; 251/77, 133, 134

[56] References Cited

U.S. PATENT DOCUMENTS

| | | | |
|---|---|---|---|
| 2,610,810 | 9/1952 | Pelough | 251/77 X |
| 3,090,558 | 5/1963 | Vaughn | 236/1 G |
| 4,079,884 | 3/1978 | Sherman | 236/1 G |
| 4,205,783 | 6/1980 | Dietsche et al. | 431/20 X |
| 4,264,023 | 4/1981 | Kutzner et al. | 236/1 G |
| 4,264,296 | 4/1981 | Folkerts | 236/1 G |

*Primary Examiner*—William E. Tapolcai

*Attorney, Agent, or Firm*—Krass, Young & Schivley

[57] ABSTRACT

An automatic vent damper control mechanism for use on furnaces or the like having a spring loaded open position and an electric motor which drives it to a closed position, against the spring bias, via a gear train. A unique over-travel mechanism is provided which prevents damage to the gear train from occurring when the damper reaches the end of its travel towards its open condition.

4 Claims, 6 Drawing Figures

VENT DAMPER DRIVE

This application is a continuation of application Ser. No. 253,124, filed Apr. 10, 1981, now abandoned, which is a continuation of application Ser. No. 93,479, filed Nov. 13, 1979, now U.S. Pat. No. 4,262,652.

BACKGROUND OF THE INVENTION

1. Field of the Invention

This invention relates generally to a vent damper which is positioned in the vent passageway of a furnace or similar combustion device and blocks off the vent to prevent the passage of heated air therethrough when the furnace is not in operation. More particularly the invention relates to such a damper actuated by an automatic mechanism having an electric motor which closes the damper, a spring which opposes the motor to open the damper, and an over-travel mechanism which causes the damper to stop in its full open condition while the gear train connecting the damper, the motor, and the spring continues to idle to a stop.

2. Prior Art

The field of automatically operated vent dampers has been of increased interest in the past several years due to the rising cost and scarcity of heating fuel. When a furnace is in operation its chimney or flue must be open to the outside atmosphere so that the combustion products may exhaust outside the building. When the furnace shuts off, however, there is no longer any need for the vent to be open and, in fact, it is undesirable for it to remain so. Heated air in the furnace and in the room in which the furnace is located will tend to rise up out of the open vent resulting in significant heat loss to the building.

Closing off the vent when the furnace is not in use is the obvious solution and there are many devices commercially available that can be retrofitted to vents that will accomplish this. Many of these automatic devices use a torsion spring to open the damper and an opposing electric motor which is actuated when the furnace is not operating to close the damper and hold it in a closed position. The damper, the spring, and the motor are connected by a gear train such that as the motor closes the damper it also winds up the spring. When the motor is shut off the spring uncoils to open the damper and in doing so it spins the motor shaft in the direction opposite its drive direction until the damper reaches an end stop defining its open position.

Certain problems, however, arise when the exact requirements of such a device are noted. For instance, the vent damper must be fail-safe; i.e., noxious exhaust fumes and/or heating gas will back-up into the furnace room if the vent is closed while the furnace is operating, so the damper must be designed so that no mechanical or electrical malfunction will allow this. Thus, a relatively strong opening force is called for to insure that any friction or binding forces on the moving parts will be overcome.

Weighing against this requirement, though, is the consideration that the gear train interconnecting the damper, the motor, and the spring is relatively delicate and will not withstand much in the way of an impact such as can be caused when a moving gear train is stopped suddenly. As a powerful torsion spring drives the damper to an open position it is subjecting the gear train to a substantial amount of torque. In currently used vent dampers, when the damper reaches the end of is travel towards the open position and contacts an end stop this torque is transferred to the gear train as an impact force. Particularly sensitive to this impact is the small pinion gear which characteristically connects the motor to the gear train.

Consequently it has been necessary (1) to moderate the strength of the torsion spring in order to reduce stress and wear on the gear train and (2) to try to machine and assemble all the parts to tolerances exact enough to keep friction and binding down to a level that the spring can be relied upon to overcome when opening the damper. Due to the hostile environment that a vent damper mechanism must contend with operating in a chimney, however, it is very difficult to construct a mechanism that can maintain the narrow balance between two powerful a spring, which will damage the gear train, and too weak a spring, which will not be able to overcome the friction and drag that will generally increase as the damper becomes dirty, corroded, and worn during its service life.

The graph of FIG. 6 is a plot of damper position—ranging from fully open to fully closed—versus the torque provided by the torsion spring. Line M indicates the torque path for the conventional spring return mechanism. Point A gives the torque contained in the spring in its fully wound position and point B the torque contained in the spring when the damper has reached its end stop and the spring has stopped unwinding. This torque path is ideal in that it is high enough through the entire range to insure that the damper will open, and low enough so that when the damper reaches its open position excessive strain is not placed on the gear. Lines H and L indicate respectively the highest and lowest variations of the torque path about the mean that are allowable in a vent damper control mechanism. If Line H is exceeded an unacceptable amount of stress as applied to the gear train when the damper reaches its end stop and if Line L is not exceeded the spring torque is not sufficient to insure full opening of the damper. These tolerances must be maintained for proper operation of the vent damper, but current manufacturing techniques cannot consistently do so.

The results of the foregoing engineering conflict is that vent dampers currently on the market are expensive to manufacture to the exacting tolerance required and even then are less than totally reliable and have a short service life.

BRIEF SUMMARY OF THE INVENTION

In the present invention the necessity for using a torsion spring of a moderate strength to avoid gear damage is eliminated by incorporating an over-travel mechanism which allows the use of a powerful spring by preventing its greater torque from being applied to the gear train so as to damage it. This over-travel feature opens the damper fully and then permits the gear train and the motor to slowly decelerate instead of causing the impact that occurs in the conventional mechanisms when they suddenly stop with the damper when it hits its end stop in the open position. In this way an automatic vent damper is provided which insures positive opening and closing of the damper and long service life without prohibitively expensive quality control required in this manufacture.

A further object of the present invention is the ease of assembly inherent in its construction.

Still another object of the invention is its modular construction which enhances inventory control during its manufacture.

Other features and advantages of the invention will become apparent from a reading of the following specification which describes the best known mode of the invention in such clear and concise detail as to enable persons skilled in the art to make and use the same.

DETAILED DESCRIPTION OF A PREFERRED EMBODIMENT

Figure 1:
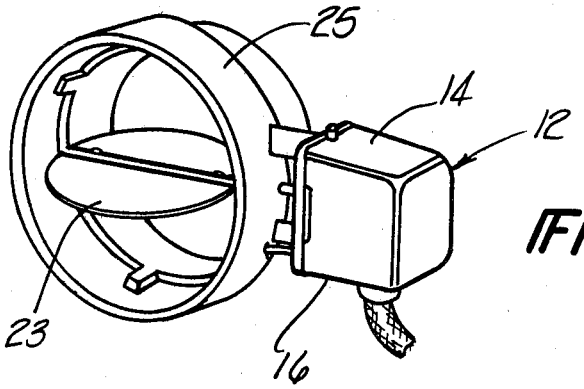
FIG. 1 is a perspective view of the automatic vent damper attached to a vent.
Figure 2:
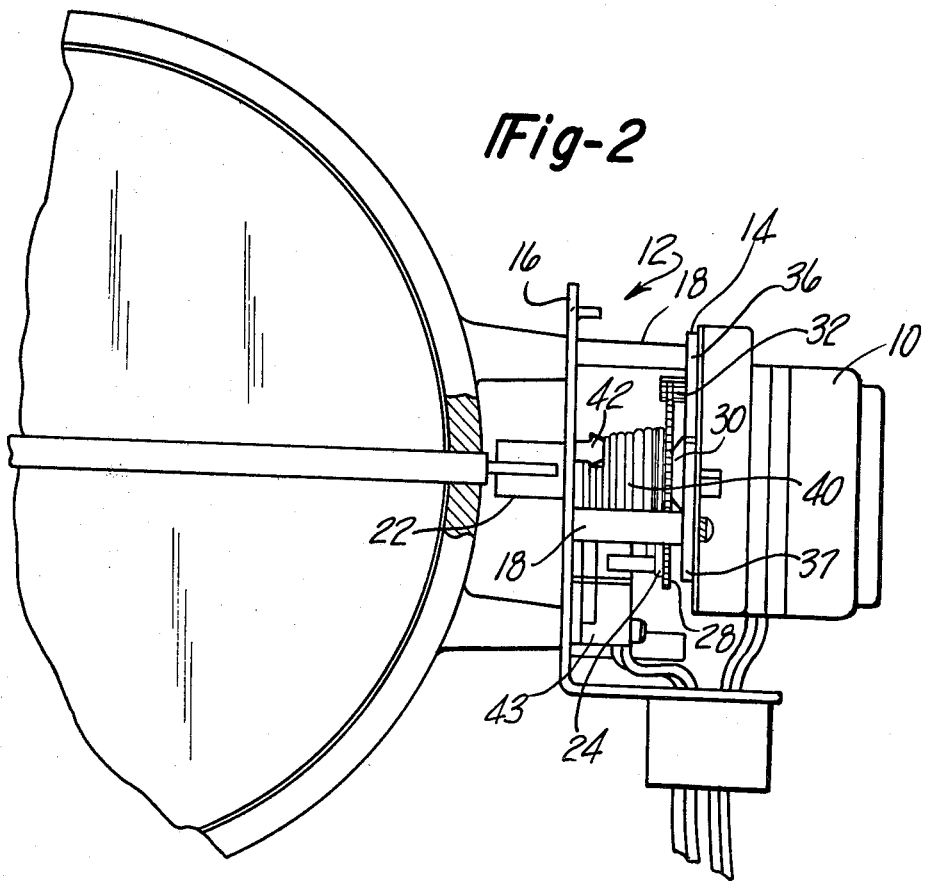
FIG. 2 is a elevational view of the automatic vent damper with the housing removed.
Figure 3:
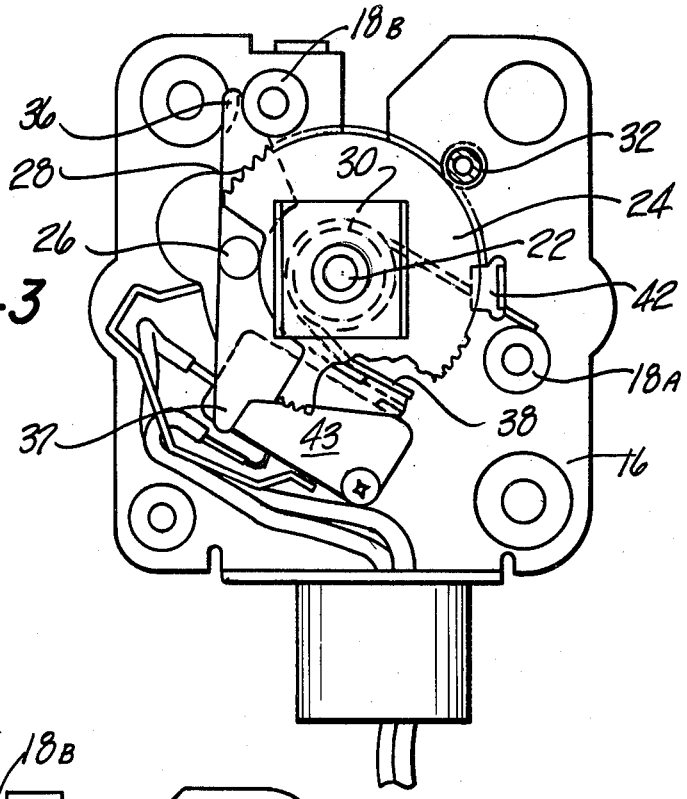
FIG. 3 is a side view of the automatic vent damper partially cut away in the damper open position.
Figure 4:
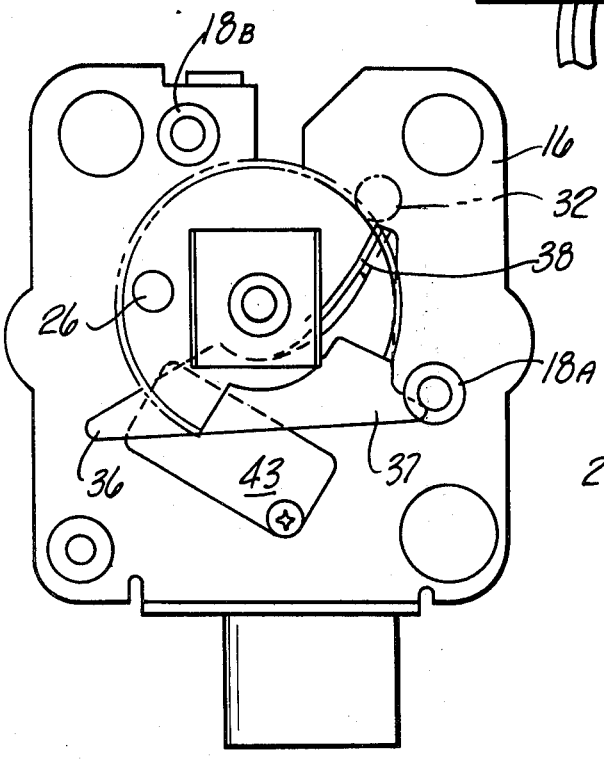
FIG. 4 is a side view of the automatic vent damper in the damper closed position.
Figure 5:
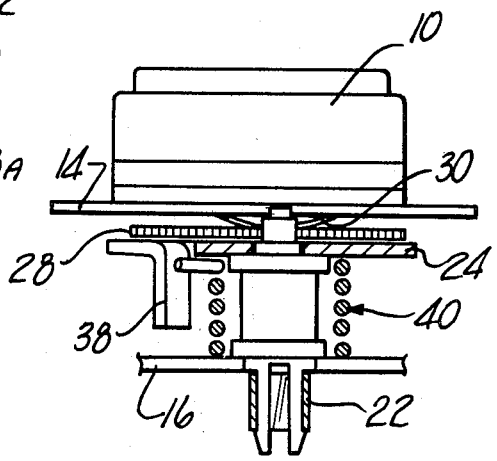
FIG. 5 is a cross-sectional view of the automatic vent damper.
Figure 6:
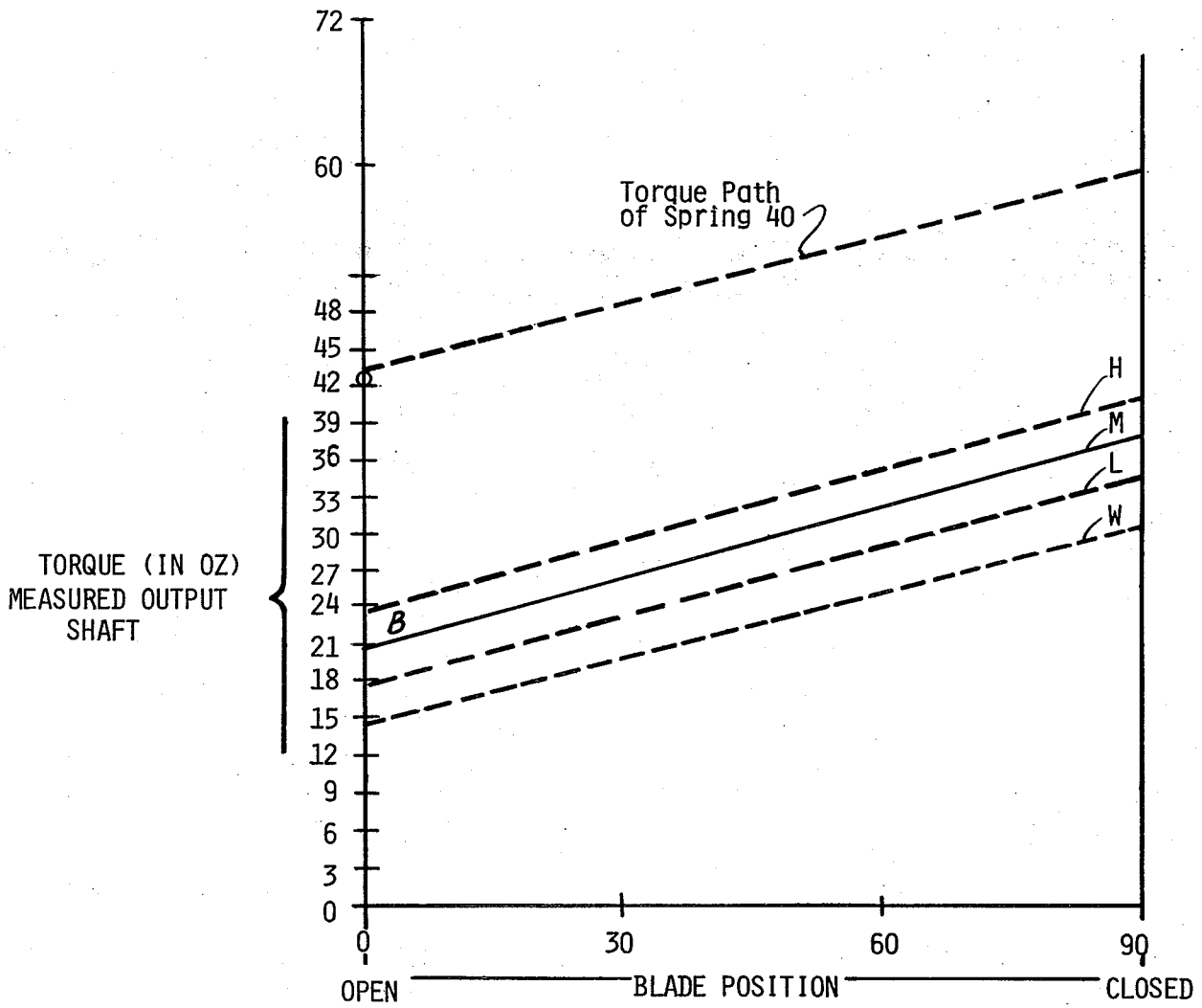
FIG. 6 is a graph of the torque path of the spring through the range of blade positions.

Referring now to FIGS. 1 through 3 the preferred embodiment of my invention is shown to comprise an electric motor 10 mounted on top of a housing generally indicated at 12 which consists of an upper housing plate 14, a lower housing plate 16, and two housing posts 18 which hold the housing plates 14, 16 in a spaced parallel relationship. Holes in housing plates 14, 16 hold drive shaft 22 so it may rotate freely about its axis. The lower end of drive shaft 22 is operatively connected to the vent damper vane 23 which is mounted in a vent 25 and closes off or opens it depending on the rotational position of drive shaft 22. Firmly attached to drive shaft 22 adjacent its upper end is drive disc 24 which has drive pin 26 projecting from its upper surface. Sector gear 28 lies flush on top of drive disc 24 and is freely rotatable about drive shaft 22. Sector gear 28 takes the form of a circular gear having with an arcuate section of approximately 90° removed therefrom. It is positioned on top of drive disc 24 so that the drive pin 26 projects up into the cutout in sector gear 28. Thus sector gear 28 will rotate independently of drive disc 24 and drive shaft 22 over a range of approximately 90° until contact is made with drive pin 26 whereupon the three components will rotate as a unit. A spring washer 30 is freely mounted on the drive shaft 22, disposed between upper housing plate 14 and sector gear 28 to apply pressure on sector gear 28 thereby maintaining firm planar contact between sector gear 28 and drive disc 24.

Motor 10 is mounted on upper housing plate 14, its output drives a pinion gear 32 which engages with sector gear 28.

The lower portion drive disc 24 is formed with first and second stop arms 36 and 37 extending tangentially outward from drive disc 24 and a tang 38 extends downward therefrom. Coaxial with and surrounding drive shaft 22 between lower housing plate 16 and stop plate 34 is a torsion spring 40 which is preferably of approximately 50 to 60 inch ounces of torque. Spring 40 is constrained in a torqued condition, its lower end held by post 42 projecting upward from lower housing plate 16, and its upper end by tang 38. The spring torque acts against tang 38 to rotate drive shaft 22 towards the position corresponding to the fully open position of the damper.

An electric switch 43 in circuit with the combustion apparatus of the furnace is mounted on lower housing plate 16 in a position so that its actuating button will be fully depressed by tang 38 as end stop arm 36 contacts housing post 18B which serves as an end stop defining the fully open position of the damper blade 23. When the switch 43 is contacted by tang 38 it is closed, thereby completing the circuit which sends a signal to the furnace control that the damper blade is in the fully open position and ready for combustion to take place in the furnace. When the damper vane 23 is in any rotational position other than fully open, the switch 43 will be maintained in the open condition to prevent the furnace from operating.

OPERATION

When the furnace is in operation, the motor 10 is not energized and spring 40 holds the damper vane 23 in its fully open position defined by stop arm 36 meeting housing post 18B and tang 38 meeting switch 43 and thereby closing the circuit to permit the furnace burner to operate. To shut the furnace off motor 10 is activated to turn sector gear 28 by way of pinion gear 32. As sector gear 28 turns about drive shaft 22 the edge of its arcuate cutout wil come into contact with drive pin 26 and further rotation will cause drive disc 24 and drive shaft 22 to revolve along with sector gear 28. Drive disc 24 will rotate, moving the attached tang 38 out of contact with switch 42 and opening the circuit to shut off the furnace. Continued rotation forces tang 38 to bear upon spring 40, thereby winding it until stop arm 36 contacts housing post 18A which serves as an end stop defining the fully closed position of the damper.

The damper control mechanism will remain in this condition until motor 10 is switched off. When this is done spring 40 unwinds, acting against tang 38 to rotate drive disc 24, drive shaft 22, sector gear 28, pinion gear 32 and motor 10. These elements all revolve as a unit until stop arm 36 contacts and is stopped by housing post 18B and tang 18 simultaneously trips switch 42 whereupon the furnace is allowed to begin operation and drive shaft 22 and drive disc 24 stop in their positions corresponding to the damper's fully open position. At this point, in a damper control mechanism of standard design the gears and motor would come to an abrupt stop along with the drive shaft, the cutout in sector gear 28 allows sector gear 28, pinion gear 32, and motor 10 to continue rotating under their own inertia, losing torque transmitting contact with drive pin 26 and idling to a stop. The arcuate cutout in sector gear 28 should be of an angle large enough so that these elements will come to a stop before drive pin 26 obstructs the rotation of sector gear 28.

It will be understood that the invention has been described with reference to a specific illustrative embodiment and that the foregoing description is not to be construed in a limiting sense.

The embodiment of the invention in which an exclusive property or privilege is claimed are defined as follows:

1. A drive system for a damper which is supported in a housing for motion between first and second positions, comprising: a shaft attached to the damper so that axial rotation of the shaft moves the damper between said first and second positions; a pair of stops fixed with respect to the housing; stop means connected to the shaft for engaging said first and second stop means at extreme positions of motion of the damper to limit motion of the damper between said first and second positions; bias means fixed between the housing and the shaft adapted to urge motion of the damper toward said first position; a uni-directional drive motor having an output and being adapted when energized to overcome said bias means and move said damper toward said second position; and means connecting the output of the drive motor to the shaft, said connecting means including means for allowing limited rotation of the drive motor under the force of inertia after the damper has reached the end of its travel toward the first position under the force of the bias means, said means for allowing limited rotation including a gear member drivingly coupled with said drive motor and mounted for rotation on said shaft, said gear member including a cutout therein, said connecting means further including a drive member mounted on said shaft for rotation therewith, said stop means being carried on said drive member, said drive member including a projection extending through said cutout in said gear member and adapted to drivingly engage said gear member at opposite extremities of said cutout.

2. The drive system of claim 1 wherein said connecting means includes a pinion gear fixed to the output of the drive motor, said gear member having teeth in meshed engagement with the pinion gear, and said drive member includes means drivingly coupled with said bias means whereby said drive member is biased to be rotated in a direction moving said damper toward said first position thereof.

3. The drive system of claim 1 wherein said bias means comprises a torsion spring coiled about the shaft having one end connected to the housing and the other end connected to the shaft.

4. A drive system for a damper supported within a housing for motion between first and second positions, comprising: a shaft connected to the damper so that rotation of the shaft moves the damper between its first and second positions; a torsion spring connected betwen the shaft and the housing to urge rotation of the shaft in a direction producing motion of the damper toward its first position; an electric drive motor having an output shaft which rotates in a first direction when the motor is energized; stop means for preventing rotation of the shaft beyond limits defined by the first and second positions of the damper; and connector means for drivingly connecting the motor output shaft to the drive shaft and operative to move the drive shaft to rotate said damper toward its second position, against the spring bias, when the motor is energized, said connector means including means for allowing a limited degree of motion of the motor shaft independent of rotation of the drive shaft whereby the motor shaft may continue in motion under the force of inertia after the drive shaft and the damper have reached the end of their travel toward said first position, said means for allowing a limited degree of motion including a gear member on said output shaft and drivingly coupled with said motor, said gear member including a pair of circumferentially spaced stops, said connector means further including a drive member secured to said shaft and coupled with said spring so as to be normally biased to rotate said damper toward said first position thereof, said drive member including a drive element adapted to engage said either of said stops and a pair of circumferentially spaced arms each adapted for engaging said stop means.

* * * * *

UNITED STATES PATENT AND TRADEMARK OFFICE

CERTIFICATE OF CORRECTION

PATENT NO. : 4,421,096

DATED : December 20, 1983

INVENTOR(S) : Thomas J. Butzen

It is certified that error appears in the above-identified patent and that said Letters Patent are hereby corrected as shown below:

Column 2, line 1 "is travel" should be --its travel--

Column 4, line 27 "wil" should be --will--

Column 4, line 42 "tang 18" should be --tang 38--

Signed and Sealed this

*Third* Day of *July 1984*

[SEAL]

*Attest:*

GERALD J. MOSSINGHOFF

*Attesting Officer*

*Commissioner of Patents and Trademarks*